US007219642B1

(12) United States Patent
Kwiatkowski et al.

(10) Patent No.: US 7,219,642 B1
(45) Date of Patent: May 22, 2007

(54) POWERTRAIN ASSEMBLY AND INTEGRAL TRUSS OIL PAN THEREFOR

(75) Inventors: Adam S. Kwiatkowski, Commerce, MI (US); Randall S. Beikmann, Brighton, MI (US); Julie A. Brown, Ann Arbor, MI (US); Jeffrey D. Curtis, Belleville, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 75 days.

(21) Appl. No.: 11/352,936

(22) Filed: Feb. 10, 2006

(51) Int. Cl.
*F02B 77/00* (2006.01)

(52) U.S. Cl. ..... 123/195 C

(58) Field of Classification Search ..... 123/193 R, 123/195 C, 195 A
See application file for complete search history.

(56) References Cited

U.S. PATENT DOCUMENTS 3,942,502 A * 3/1976 Gorres et al. ..... 123/195 R
4,452,192 A * 6/1984 Hayashi ..... 123/195 R
4,465,041 A * 8/1984 Hayashi ..... 123/195 R
4,473,042 A * 9/1984 Kikuchi ..... 123/195 R
4,569,317 A * 2/1986 Hayashi ..... 123/195 R
4,650,030 A * 3/1987 Moriyama et al. ..... 180/292
4,770,276 A * 9/1988 Takubo ..... 184/106
4,838,221 A * 6/1989 Suemori ..... 123/195 H
4,911,118 A * 3/1990 Kageyama et al. ..... 123/195 H
5,456,228 A * 10/1995 Meurer et al. ..... 123/195 H
5,526,781 A * 6/1996 Sugiyama et al. ..... 123/195 C
5,954,022 A * 9/1999 Katayama et al. ..... 123/195 P
6,041,751 A * 3/2000 Kuriyama et al. ..... 123/195 C
6,079,383 A * 6/2000 Shirai et al. ..... 123/192.2
6,131,543 A * 10/2000 Achenbach et al. .... 123/195 C
6,186,111 B1 * 2/2001 Hilbig et al. ..... 123/195 H
6,520,293 B1 * 2/2003 Ogawa et al. ..... 184/6.22
6,584,950 B1 * 7/2003 Cunningham ..... 123/195 C
6,729,206 B2 * 5/2004 Hayabuchi et al. ..... 74/606 R
6,912,986 B2 * 7/2005 Higashide et al. ..... 123/195 A

* cited by examiner

*Primary Examiner*—Stephen K. Cronin
*Assistant Examiner*—Aaron Wilson
(74) *Attorney, Agent, or Firm*—Christopher DeVries

(57) ABSTRACT

A cast oil pan is connected between en engine crankcase and a lower end portion of a transmission bellhousing. Oil pan side walls each incorporate an integrally cast truss extending between an end flange of the oil pan and adjacent portions of an upper flange to stiffen the connection of the engine crankcase with the transmission bellhousing. Each truss includes a horizontal rail, a plurality of bolt columns extending between the horizontal rail and the upper flange adjacent corresponding bolt openings. Diagonal ribs extend from the oil pan flange generally toward the peripheral end flange. Oil pan bolts at the truss locations pass through the horizontal rail and the oil pan upper flange adjacent the bolt columns so that bolt clamping forces are carried through the bolt columns. The heads of the bolts are positioned below the horizontal rail accessible by power tools for securing and removing the bolts.

10 Claims, 4 Drawing Sheets

POWERTRAIN ASSEMBLY AND INTEGRAL TRUSS OIL PAN THEREFOR

TECHNICAL FIELD

This invention relates to engine/transmission powertrain assemblies and, more particularly, to integral truss oil pans for stiffening such assemblies.

BACKGROUND OF THE INVENTION

In an automotive powertrain, a stiff junction between an engine block and a connected transmission bellhousing would benefit from a straight vertical wall, such as a "shear wall", on the sides of the connecting engine oil pan. The need for tool access, however, tends to move the wall surrounding the oil pan bolts inward. To do this, while maximizing oil volume, requires moving the wall outward between the bolts. The result is an accordion shaped or corrugated sidewall that is easily bent, compromising the pan's contribution to powertrain bending stiffness. An improved oil pan is desired having increased structural stiffness in areas adjoining the transmission bellhousing and adjacent portions of the engine block oil pan flange

SUMMARY OF THE INVENTION

The present invention provides an improved powertrain assembly wherein an engine to transmission connection is stiffened by incorporating integrally cast trusses in oil pan sidewalls at portions mounted between the engine crankcase and a lower portion of a transmission bellhousing. The trusses stiffen adjacent portions of the oil pan walls and receive extended oil pan bolts having heads engaging a lower truss portion accessible by power tools for securing and removing the bolts.

The integrally cast trusses each include a horizontal rail extending generally parallel to an oil pan upper flange and including bolt openings aligned with corresponding bolt openings in the upper flange. A plurality of bolt columns extend between the horizontal rail and the oil pan upper flange adjacent to the corresponding bolt openings of at least selected locations. A plurality of diagonal ribs extend from the oil pan flange generally toward a rear mounting flange connectible with a transmission bellhousing in the oil pan upper flange to adjacent portions of the rear mounting flange.

Some of the diagonal ribs extend directly from adjacent longitudinally spaced bolt openings in the oil pan upper flange to adjacent portions of the rear mounting flange. Additional diagonal ribs extend directly from adjacent upper flange bolt openings to openings for longitudinally spaced bolts in the horizontal rail.

The oil pan is die castable with the integral cast-in trusses with a minimal effect on manufacturing costs.

These and other features and advantages of the invention will be more fully understood from the following description of certain specific embodiments of the invention taken together with the accompanying drawings.

DESCRIPTION OF AN EXEMPLARY EMBODIMENT

Figure 1:
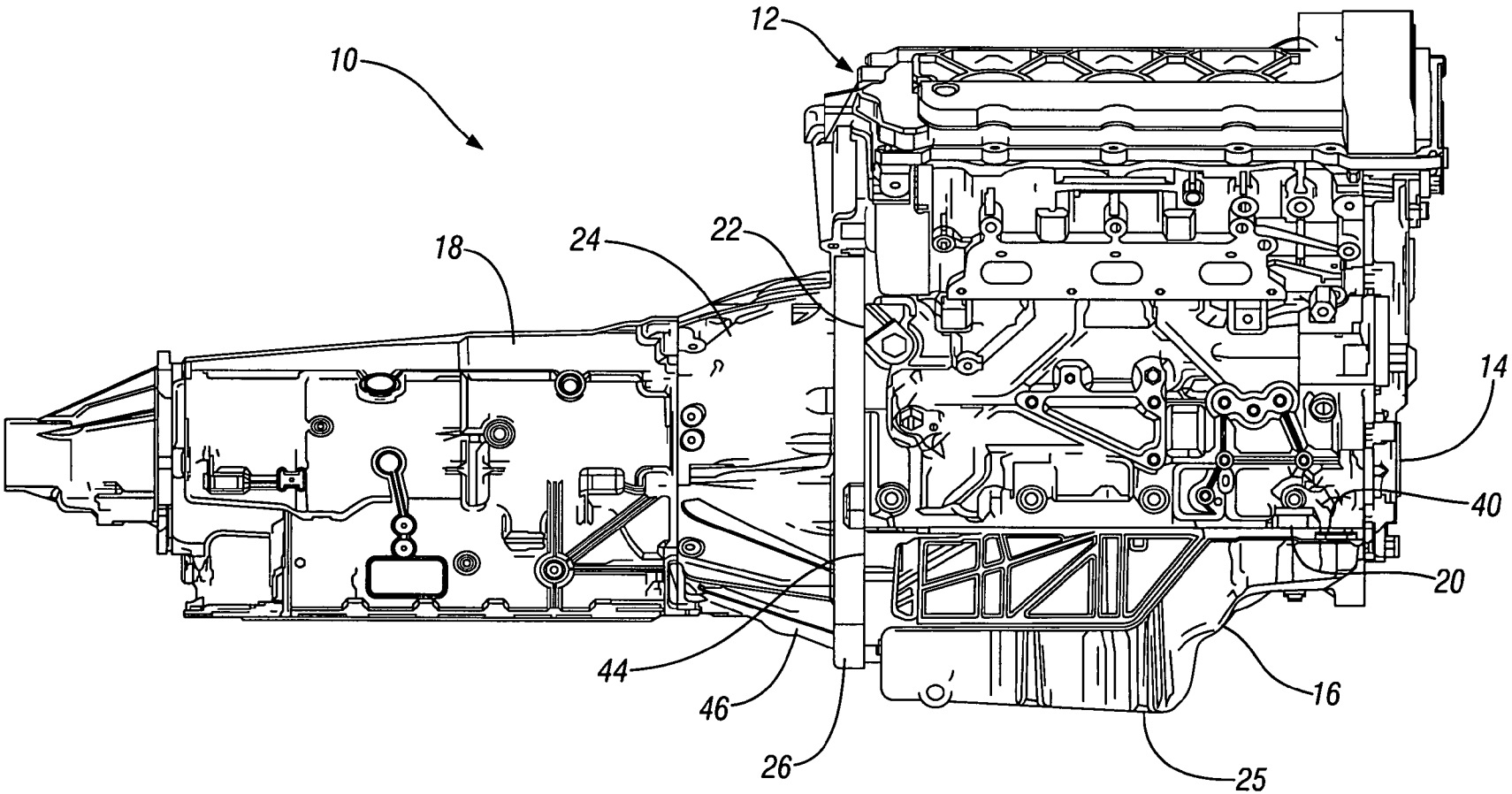
FIG. 1 is a side view of an automotive powertrain assembly formed according to the invention and including an engine and a transmission mounted to a crankcase and oil pan of the engine.

Referring first to FIG. 1 of the drawings in detail, numeral 10 generally indicates a powertrain assembly adapted for automotive application. Assembly 10 includes an engine 12 having a crankcase 14 and an oil pan 16 mounted together with an automatic transmission 18.

The crankcase internally supports a power producing mechanism, not shown, such as a crankshaft, and includes a peripheral lower face 20 mounting the oil pan and a rear mounting face 22 mounting a bellhousing 24 of the transmission. The oil pan 16 includes a rear sump 25 and is mounted to the lower face 20 of the crankcase for containing engine oil for lubricating internal components, not shown, of the engine. The automatic transmission 18 is conventionally mounted to the engine 12 with a front flange 26 of the bellhousing 24 bolted to the rear mounting face 22 of the crankcase.

Figure 2:
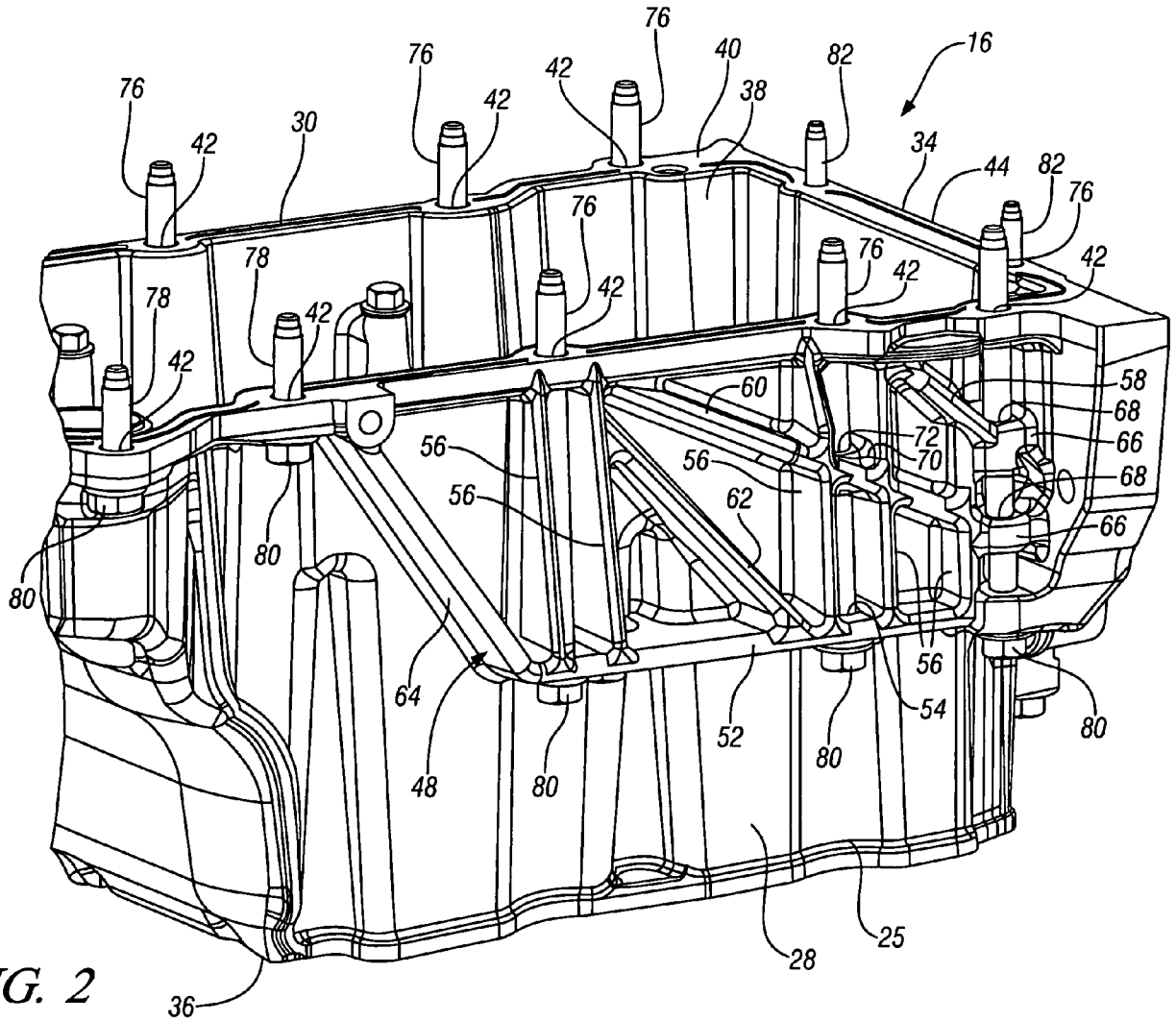
FIG. 2 is a right rear corner pictorial view of a first embodiment of oil pan according to the invention.
Figure 3:
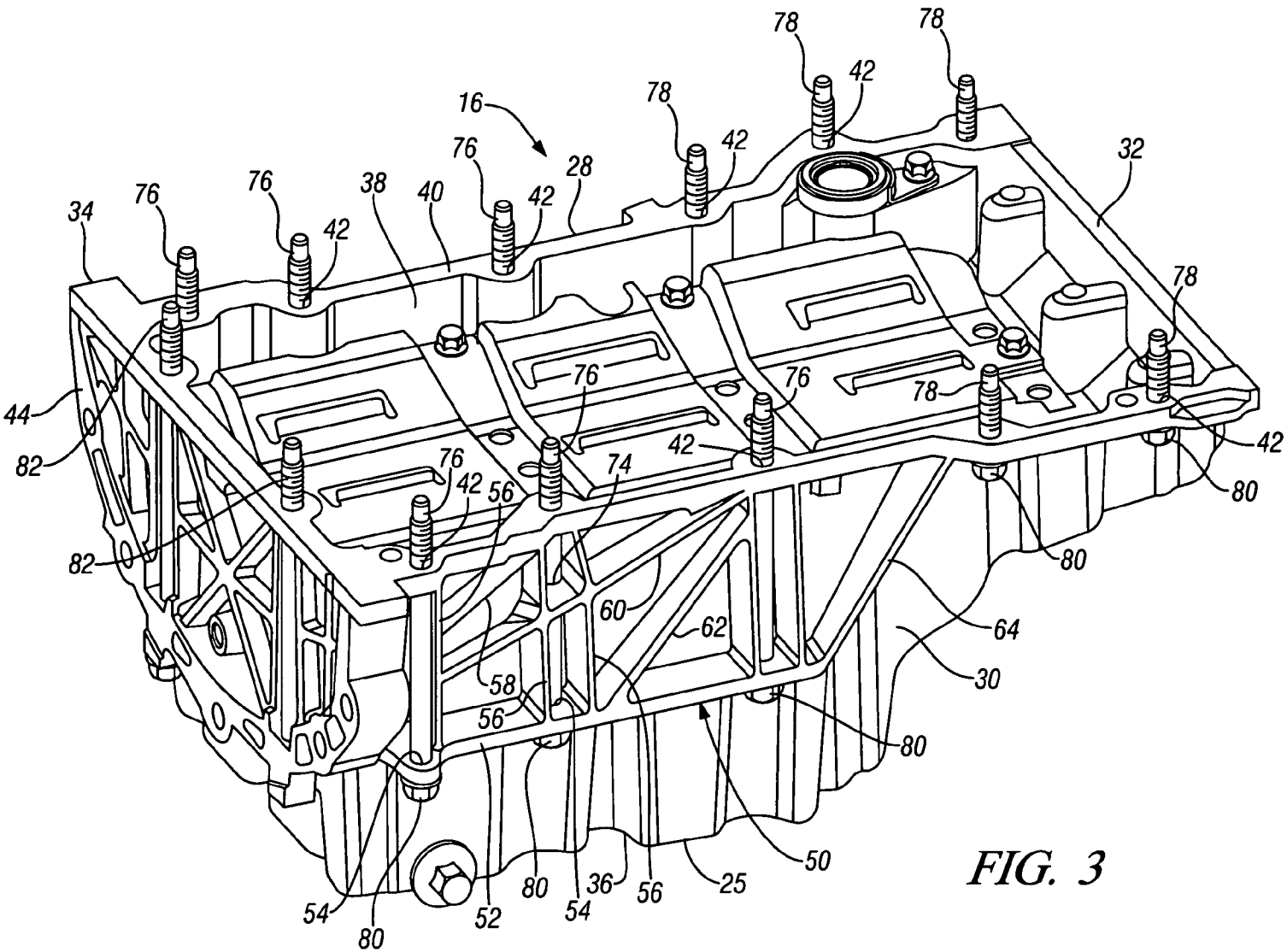
FIG. 3 is a fragmentary pictorial view from the left front corner showing the truss on the rear sump portion of the embodiment of FIG. 2.

As shown best in FIGS. 2 and 3, the oil pan 16 is formed as an integral casting preferably a diecasting, although other casting or molding processes may be employed if desired or mandated by a choice of materials in appropriate applications. The pan structure includes left 28 and right 30 sidewalls and front 32 and rear 34 end walls and a bottom wall 36 defining a cavity 38 including the rear sump 25 for retention of engine oil.

A peripheral upper flange 40 defines upper edges of the pan walls and includes longitudinally spaced bolt openings 42 in the flange portions of the left and right sidewalls 28, 30. A peripheral end flange 44 is also formed on the rear end wall 34 of the oil pan 16. The end flange 44 is engaged in assembly by the front flange 26 of a lower portion 46 of the transmission bellhousing 24, which is bolted to the end flange 44 to provide a stiff connection of the transmission lower portion 46 with the engine crankcase 14 through the oil pan sidewalls 28, 30.

The left and right oil pan sidewalls 28, 30 each incorporate an integrally cast truss generally indicated by numerals 48, 50, respectively. The trusses are essentially identical with only minor variations in specific integration due to necessary variations in the wall contours.

Each of the trusses extends between the end flange 44 of the oil pan and adjacent portions of the peripheral upper flange 40. Each truss 48, 50 includes a horizontal rail 52 extending generally parallel to the upper flange 40 and including bolt openings 54 aligned with corresponding bolt openings 42 in the upper flange. A plurality of bolt columns 56 extend between the upper flange 40 adjacent the corresponding bolt openings of at least selected locations.

A plurality of diagonal ribs 58, 60, 62, 64 are also provided extending from the oil pan upper flange 40 generally toward the peripheral end flange 44. Ribs 58 and 60 extend downward and rearward to the peripheral end flange 44 from the peripheral upper flange 40 adjacent the second and third bolt openings 42, respectively, from the peripheral end flange 44.

Ribs 58 on both sidewalls extend diagonally from a bolt column 56 adjacent the second upper flange bolt opening 42

(from the end flange 44) to the peripheral end flange 44. Ribs 60 extend diagonally from a bolt column 56 adjacent the third upper flange bolt opening 42 (from the end flange 44) to the peripheral end flange 44. The ribs 58, 60 also intersect intervening bolt columns along their lengths.

On the left sidewall (FIG. 3), the ribs 58, 60 include enlarged portions 66 with bolt openings 68 aligned with the first pair of bolt openings 42, 54 adjacent the end flange 44. Ribs 60 also include a second enlarged portion 70 with a bolt opening 72 aligned with the second pair of bolt openings 42, 54 from the end flange 44.

On the right sidewall (FIG. 2), the rib details differ slightly in that the first pair of bolt openings 42, 54 are moved outward so that the ribs 58, 60 pass behind the associated bolt location without requiring enlarged portions in the ribs. Also, the rib 60 is deeper at the location of the second pair of bolt openings from the end flange 44 so that a bolt opening 74 is formed in the rib 60 without needing an enlarged portion of the rib. These differences are only variants of the basic truss structures, which are adjusted to conform to variations in the sidewall configurations and bolt locations required by the particular engine design and packaging considerations.

Diagonal ribs 62 and 64 extend downward and rearward from adjacent the third and fourth bolt openings 42 in the upper flange 40 (from the end flange 44) to adjacent the second and third bolt openings 54 in the horizontal rail (from the end flange 44) to stiffen the truss structure and carry longitudinal loads from the end flange 44 to the pan upper flange 40. Specifically, diagonal ribs 62 extend between a bolt column 56 adjacent the third pan flange bolt opening 42 location (from the end flange 44) to the horizontal rail 52 at the bolt column 56 location adjacent the second rail bolt opening location (from the end flange). Similarly, diagonal ribs 64 extend between the upper flange 40 adjacent the fourth bolt opening 42 (from the end flange 44) to the horizontal rail 52 at the bolt column 56 location adjacent the third pan rail bolt opening 54 location (from the end flange 44).

In assembly, the oil pan sidewalls 28, 30 are secured to the sides of the engine crankcase by fastening bolts including six long bolts 76 (three on each side) and five shorter bolts 78 (three on the left side and two on the right side). The number and location of fastening bolts may be varied to meet the requirements of the particular engine design.

The three long bolts 76 on each side extend through the first, second and third (from the end flange 44) pairs of bolt openings 54, 42, from the truss longitudinal rail openings 54 through the corresponding upper flange 40 openings 42 to engage fastener openings, not shown, in the crankcase lower face 20. Heads 80 of the bolts engage the horizontal rail 52 and place the bolt columns 56 in compression to hold the pan 16 in place. Similarly, the five shorter bolts 78 extend through other sidewall flange openings 42 to engage crankcase fastener openings, not shown, the bolt heads 80 also engaging the pan upper flange 40. Additional oil pan securing bolts may also be used, such as long rear bolts 82 that extent through vertical openings in the pan end flange 44 to support the transmission-connected rear end of the pan.16. All these fasteners cooperate with the pan structure, including the integral trusses, 48, 50 to maintain a stiffened connection between the engine crankcase 14 and the lower portion of the transmission bellhousing 24 through the oil pan truss structures 48, 50 in accordance with the invention.

Figure 4:
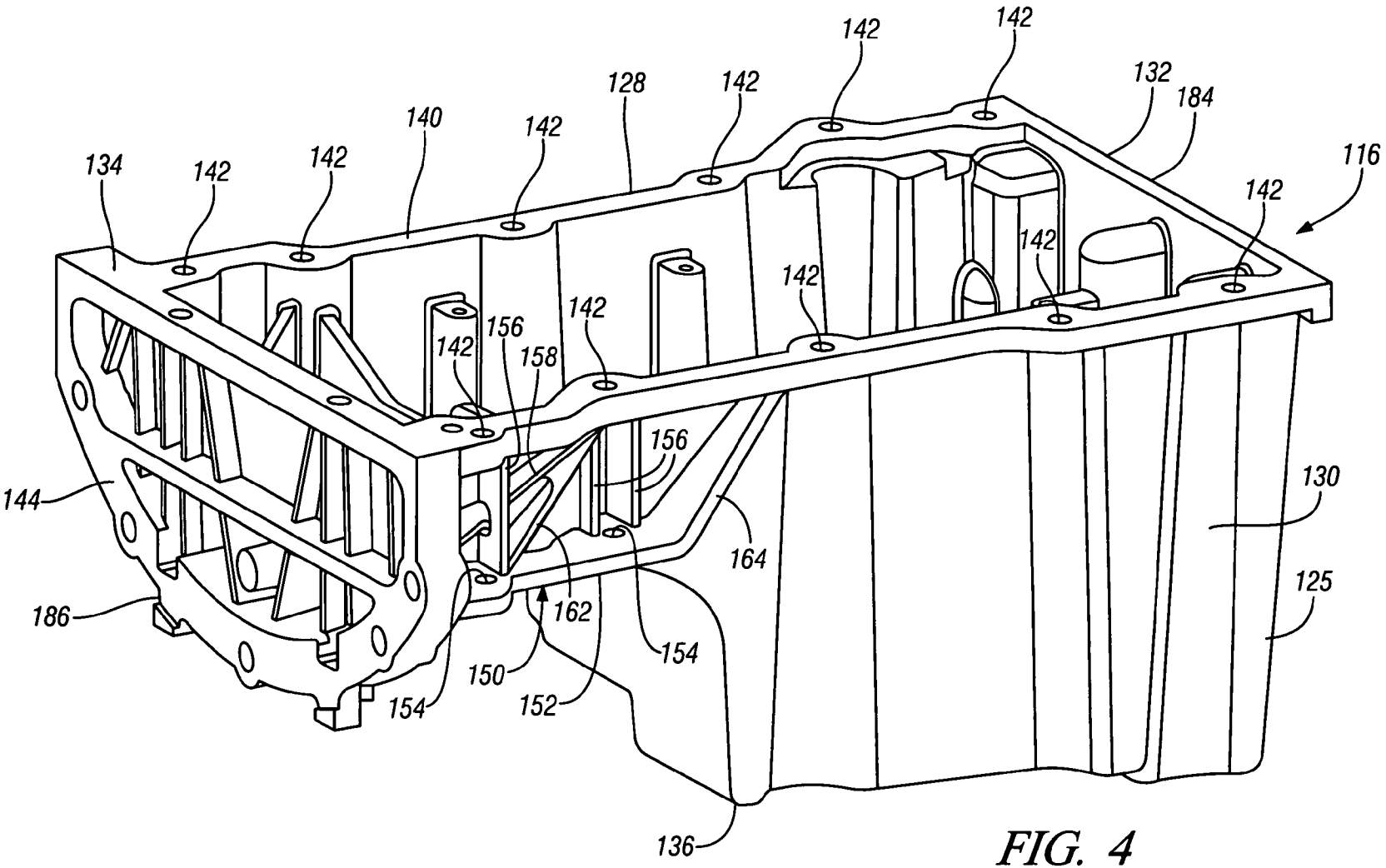
FIG. 4 is a view similar to FIG. 2 but showing the invention embodied in a forward sump oil pan.

Referring now to FIG. 4 of the drawings, an alternative embodiment of oil pan 116 according to the invention is shown. Oil pan 116 differs from the oil pan 16 in that the sump 125 is moved to a front end 184 of the pan. Thus, the rear end 186 is shallower and terminates in a smaller peripheral end flange 144 adjoining the peripheral upper flange 140 with its bolt openings 142. Details of the bolt opening positions are similar since the pans are designed for use with the same or a similar engine crankcase, not shown.

As in the first embodiment, the now shallower rear end 186 of the oil pan connects with and supports the lower portion of a transmission, not shown, through the end flange 144. The pan sidewalls 128, 130 are stiffened at the rear ends by trusses, only the right sidewall truss 150 being shown. The truss structure is smaller but similar to that previously described to accomplish the same purposes.

Referring to truss 150 as exemplary, it includes a horizontal rail 152 generally parallel to the pan upper flange 140 as before. However, the truss 150 is shorter by one bolt spacing, so the length of the rail 152 is shorter. Also, there are bolt columns 156 for only the long bolts, not shown, of the first and second bolt opening pairs (counting from the end flange 144). Further, the truss 150 includes only 3 diagonal ribs including one rib 158 extending from adjacent the second flange bolt opening 142 (from the end flange 144) to the end flange 144. The two other diagonal ribs 162, 164 extend between the upper flange 140 and the horizontal rail 152. Rib 162 connects a bolt column 156 adjacent the second (from the end flange 144) pan flange bolt opening 142 with the bolt column 156 adjacent the first (from the end flange 144) pan rail bolt opening 154. Rib 164 connects the two next further bolt opening locations, that is the third (from the end flange) pan flange bolt opening 154 location is connected to the second (from the end flange) pan rail bolt opening 154 location.

As in the first embodiment, the smaller structure stiffens the pan walls at the rear end of the oil pan and provides a connection of increased stiffness through the oil pan between the engine crankcase and the lower portion of the associated transmission bellhousing.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. A powertrain assembly for automotive use comprising:

an engine including a crankcase for supporting a power producing mechanism, the crankcase including a peripheral lower face for mounting an oil pan and a rear mounting face for mounting a transmission bellhousing for connection of the engine mechanism with power transmitting mechanism in a transmission;

a transmission having a bellhousing mounted on the rear mounting face; and a cast oil pan including peripheral side, front and rear end walls and a bottom wall defining a cavity for retention of engine oil, the oil pan having a peripheral upper flange and a peripheral end flange, the upper flange mounted to the peripheral lower face of the crankcase by oil pan bolts extending through openings in the upper flange at longitudinally spaced locations along each flange, and a lower portion of the transmission bellhousing mounted against the peripheral end flange of the oil pan;

the oil pan side walls each incorporating an integrally cast truss extending between the end flange of the oil pan and the adjacent portions of the upper flange to stiffen the connection of the engine crankcase through the oil pan to the lower portion of the transmission bellhousing, each truss including a horizontal rail extending generally parallel to the oil pan upper flange and including bolt openings aligned with corresponding bolt openings in the upper flange, a plurality of bolt columns extending between the horizontal rail and the oil pan upper flange adjacent the corresponding bolt openings of at least selected locations, and a plurality of diagonal ribs extending from the oil pan flange generally toward the peripheral end flange;

wherein the oil pan bolts at the truss locations are extended to pass through the horizontal rail and the oil pan upper flange adjacent the bolt columns so that the bolt clamping forces are carried through the bolt columns to the pan upper flange and the heads of the bolts are positioned below the horizontal rail accessible by power tools for securing and removing the bolts.

2. An assembly as in claim 1 wherein some of the diagonal ribs extend directly from adjacent longitudinally spaced bolt openings in the oil pan upper flange to adjacent portions of the rear mounting flange.

3. An assembly as in claim 2 wherein others of the diagonal ribs extend directly from adjacent upper flange bolt openings to the openings of longitudinally spaced bolts in the horizontal rails for stiffening the sidewall structure and distributing bending loads on the rear mounting flange to further locations of the oil pan mounting flange.

4. An assembly as in claim 1 wherein the oil pan is formed as a die casting.

5. A cast oil pan including peripheral side, front and rear end walls and a bottom wall defining a cavity for retention of engine oil, the oil pan having a peripheral upper flange and a peripheral end flange, the upper flange including bolt openings at longitudinally spaced locations along each flange and the peripheral end flange adapted to connect with a lower portion of a transmission bellhousing;

the oil pan side walls each incorporating an integrally cast truss extending between the end flange of the oil pan and the adjacent portions of the upper flange to stiffen the connection of the upper flange with the end flange, each truss including a horizontal rail extending generally parallel to the oil pan upper flange and including bolt openings aligned with corresponding bolt openings in the upper flange, a plurality of bolt columns extending between the horizontal rail and the oil pan upper flange adjacent the corresponding bolt openings of at least selected locations, and a plurality of diagonal ribs extending from the oil pan flange generally toward the peripheral end flange;

wherein the oil pan bolt openings at longitudinally spaced truss locations are adapted to receive bolts extended to pass through the horizontal rail and the oil pan upper flange adjacent the bolt columns so that bolt clamping forces are carried through the bolt columns to the pan flange and heads of the bolts are positioned below the horizontal rail accessible by power tools for securing and removing the bolts.

6. An oil pan as in claim 5 wherein some of the diagonal ribs extend directly from adjacent longitudinally spaced bolt openings in the oil pan upper flange to adjacent portions of the rear mounting flange.

7. An oil pan as in claim 6 wherein others of the diagonal ribs extend directly from adjacent upper flange bolt openings to the openings of longitudinally spaced bolts in the horizontal rails for stiffening the sidewall structure and distributing bending loads on the rear mounting flange to further locations of the oil pan mounting flange.

8. An oil pan as in claim 5 formed as a die casting.

9. An oil pan as in claim 5 and including an oil sump at an end adjacent to the peripheral end flange, wherein the trusses are integral with portions of the side walls defining portions of the oil sump and extending outward to avoid substantially reducing the internal volume of the oil pan.

10. An oil pan as in claim 5 and including an oil sump at an end opposite from the peripheral end flange, wherein the trusses are integral with portions of the side walls defining shallower portions of the pan connecting with the oil sump and extending outward to avoid substantially reducing the internal volume of the oil pan.

* * * * *